US008631626B2

(12) United States Patent
Ballantine

(10) Patent No.: US 8,631,626 B2
(45) Date of Patent: Jan. 21, 2014

(54) UNIVERSAL CONSTRUCTION FRAMING CONNECTOR

(75) Inventor: Mark Andrew Ballantine, North Bend, WA (US)

(73) Assignee: Mark Ballantine, North Bend, WA (US)

( * ) Notice: Subject to any disclaimer, the term of this patent is extended or adjusted under 35 U.S.C. 154(b) by 29 days.

(21) Appl. No.: 13/404,592

(22) Filed: Feb. 24, 2012

(65) Prior Publication Data

US 2013/0219822 A1 Aug. 29, 2013

(51) Int. Cl.
*E04B 1/38* (2006.01)
*E04C 5/00* (2006.01)

(52) U.S. Cl.
USPC ..... 52/704; 52/715

(58) Field of Classification Search
USPC ..... 52/698, 704, 707, 708, 712, 715, 220.1; 248/218.4, 219.1, 220.21, 220.22, 248/228.1; 403/199, 187, 192, 217, 231
See application file for complete search history.

(56) References Cited

U.S. PATENT DOCUMENTS

| | | | | |
|---|---|---|---|---|
| 4,050,205 | A * | 9/1977 | Ligda | 52/357 |
| 5,848,512 | A * | 12/1998 | Conn | 52/837 |
| 6,694,700 | B1 * | 2/2004 | Mackett | 52/764 |
| 7,549,258 | B2 * | 6/2009 | Lajewski | 52/220.8 |
| 2004/0129845 | A1 * | 7/2004 | Whale et al. | 248/201 |
| 2007/0246623 | A1 * | 10/2007 | Ehrhardt | 248/218.4 |

* cited by examiner

*Primary Examiner* — William Gilbert
*Assistant Examiner* — Kyle Walraed-Sullivan
(74) *Attorney, Agent, or Firm* — Mark Ballantine

(57) ABSTRACT

A universal framing connector, used to connect backing, blocking, bracing, and bridging to the framing system, framing members, and to adjacent surfaces.

3 Claims, 3 Drawing Sheets

UNIVERSAL CONSTRUCTION FRAMING CONNECTOR

CROSS-REFERENCE

| | | | |
|---|---|---|---|
| 7,520,100 B1 | Apr. 21, 2009 | Herrman et al | 11/531,902 |
| 6,253,529 B1 | Jul. 3, 2001 | De Boer | 09/355,476 |
| 5,189,857 | Mar. 2, 1993 | Herren et al | 731,549 |
| 4,658,556 | Apr. 21, 1987 | Jenkins | 643,143 |
| 6,705,056 B2 | Mar. 16, 2004 | Tollenaar | 09/999,874 |
| 6,799,407 B2 | Oct. 5, 2004 | Saldana | 10/438,060 |
| 4,869,040 | Sep. 26, 1989 | Howell | 234,683 |
| 7,621,096 B2 | Nov. 24, 2009 | Ellis | 12/082,410 |
| 7,559,519 B1 | Jul. 14, 2009 | Dragic et al | 11/493,776 |
| Provisional | Feb. 25, 2011 | Ballantine | 61/447,005 |

FEDERALLY SPONSORED RESEARCH OR DEVELOPMENT

Not Applicable

TABLES AND SEPARATELY SUBMITTED MATERIALS

Not Applicable

BACKGROUND

Modern building construction incorporates composites, wood, metal backing, and blocking within stud-framed walls and ceilings. Connecting backing, blocking, and framing members together, and to adjacent surfaces, is generally achieved by selecting bent steel angles, clips, brackets, clasps, and straps, joined together with a variety of screws, nails, welds, or other means of attachment. This invention provides a single connector for a variety of framing needs.

SUMMARY

This invention is a universal connector for joining framing members, backing, blocking, and adjacent surfaces. This invention adapts to project specific needs and, by design, field modifications to the invention determine the functionality of the connector at the joint; reducing installation difficulties associated with framing. The installation is designed with human factors principles to provide optimal installation efficiency, speed, quality, and installer safety. This invention solves logistical challenges related to the connector selection process.

DETAILED DESCRIPTION OF THE INVENTION

Figure 1:
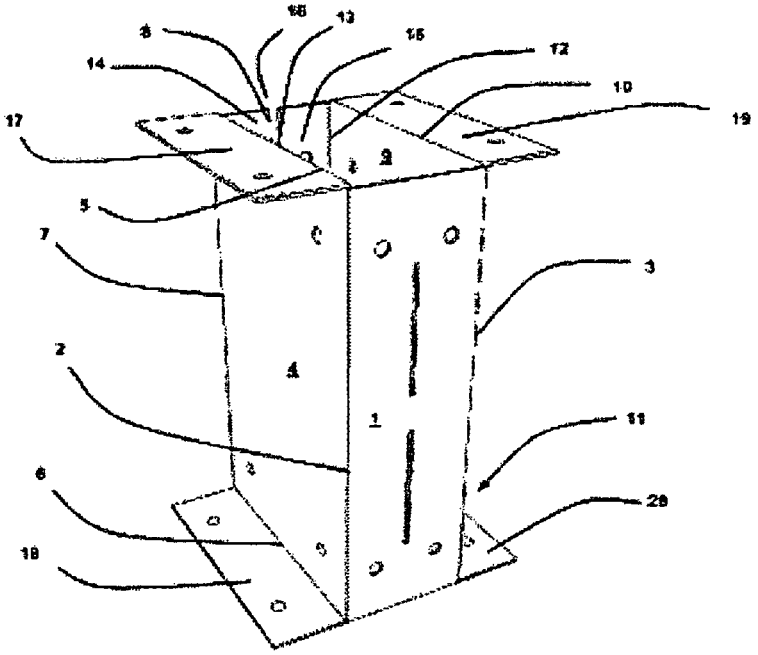
FIG. 1: illustrates an isometric view of a universal framing connector, the present invention.
Figure 2:
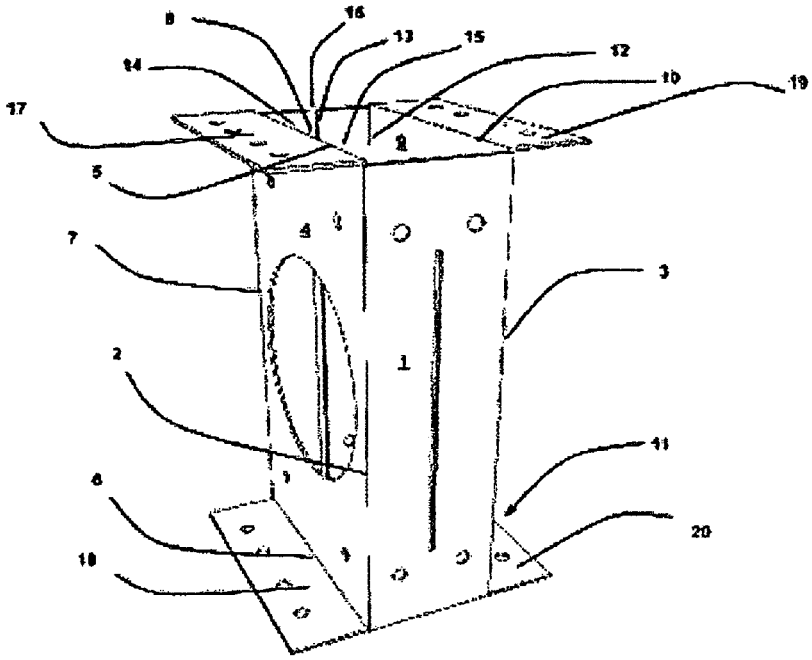
FIG. 2: illustrates an isometric view of the present invention modified to allow the passage of a pipe.
Figure 3:
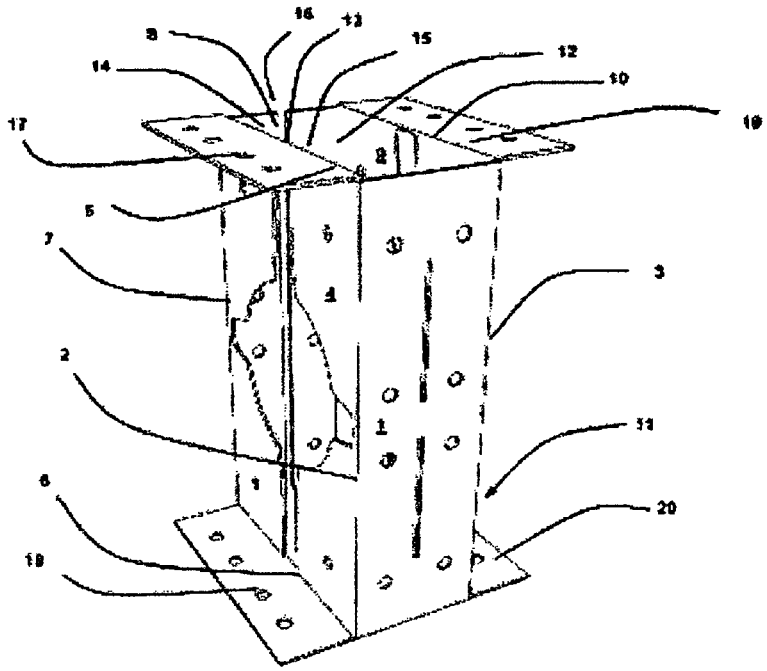
FIG. 3: illustrates an isometric view of the present invention additionally modified to facilitate dissection of the universal framing connector by installation personnel.

The present invention connects construction framing, such as engineered composites, wood, metal backing, blocking, other framing members, and adjacent surfaces. It is considered rough hardware and a framing accessory in the construction industry and is manufactured from mixed metallurgies, steel, aluminum, other metals, polymers, and other synthesizing methods formed by rolling, bending, stamping, punching, casting, extruding and other methods related to material shaping.

Surface coatings vary based on the needs of the project and connection desired. Here are a few examples: Lead coated steel backing connection for joining lead lined plywood in radiation sensitive walls; Anti-vibration, sound, electric current transfer coatings between the connector and the framing member; Galvanized coating, standard, metal and wood framing; Naked steel for welding, powder coat and paint; Corrosive resistant coatings for laboratory environments; and metal plating for static and electrical conduction.

This invention, in general, is a saddle-shaped connector. It is designed to wrap around, in full or in part, the body, face, edge, or flange of vertical and horizontal framing members, creating a pocket (Diagram 1, call out #5 and Diagram 2, call out #3.4). It is joined to the frame with screws, nails, welds, crimps, and other mechanical, engineered, and chemical means and methods. The invention is versatile, accepting different sizes and types of framing members (Diagram 3, call out #5.2). It also accepts different sizes and types of backing or blocking materials (Diagram 3, call out #5.3).

The invention varies in size to match the framing member and backing or blocking material (Diagram 1). The stud pocket (Diagram 1, call out #5) is created from a generally perpendicular relation between the invention's face (Diagram 1, call out #1) and its walls (Diagram 1, call out #2). The stud pocket "saddles" the framing member, connecting the invention to the framing system (Diagram 3, call out #5.2). It is sized to match the framing member's width and gauge where applicable. This invention's face and walls connect directly to the framing system.

The backing pocket is created by the generally perpendicular relationship between walls (Diagram 1, call out #2), wings (Diagram 1, call out #3), and tabs (Diagram 1, call out #4). It is sized to match backing and blocking material by size and type. The backing pocket connects backing materials to this invention (Diagram 3, call out #7).

This invention's body surfaces contain penetrations, screw ports, grooves, slots, protrusions, and grips, strategically located as an installation aid (Diagram 2, call outs #1.1, #1.2, and #4.1). Bodies without strategic tooling are used in connection with powered nailing equipment. A relief groove in the face of the invention supports vertical dissection (Diagram 2, call out #1.1 and Diagram 4, call out #1.4).

Walls, in general, provide horizontal limitation in the "X" plane to backing and blocking materials (Diagram 1, call out #2). Wall width and functionality vary (Diagram 2, call outs #2.1 thru #2.3). Utility passage connection provides vertical support to the framing member on either side of the utility penetration (Diagram 5, call out #12). Solid blocking, backing, bracing, and shielding can be installed on either side, both above and below the utility line.

This invention's wings are generally folded away from the pocket (Diagram 1, call out #3) to apply strategic horizontal limits in the "Z" plane, point-pressure, entrapment, and attachment surfaces for connection to backing, blocking, and framing. The wing is folded toward the pocket, on wrap-around connections (Diagram 2, call out #3.4). Wrapping aids in installing blocking, backing, bridging, and bracing in both sides of a framed wall (Diagram 5, call outs #10, 11 and 12). It connects framing members like box beams and headers to vertical framing members (Diagram 4, call out #9) and to adjacent surfaces (Diagram 4, call outs #8).

Multi-sectional wings (Diagram 2, call out #3.1) allow for horizontal dissection of the invention to permit mixed-height materials of same or similar thickness to be installed within the framing system, in effect, functioning as a corner or middle connector (Diagram 4, call out #9.1 and Diagram 5, call out #10.1). Intermediate wings and sectional wings trap backing material, while providing a connection solution and an anchorage point for grommets, rivets, wire, lines, and other installation aids (Diagram 2, call out #3.2).

Horizontally dissected connectors act back-to-back to secure framing to adjacent surfaces and blocking connectors (Diagram 4, call out #8.1 and Diagram 5, call out #10.1). Horizontally dissected wrap connectors function similarly (Diagram 4, call outs #8 and #9 and Diagram 5, call out #10). Additionally, when this invention is used as a metal blocking connection (Diagram 5, call out #3.5), the wings provide vertical movement limits to the blocking in the negative "Y" plane, while tabs limit vertical movement in the positive "Y" plane, creating a blocking trap. Screws and other fastening means, complete the connection to the invention and the framing system.

Forward wall wings (Diagram 2, call out #3.2) and folded forward wings (Diagram 2, call out #3.3) provide back pressure and attachment surfaces to connect metal strap, stud, and track backing to the invention.

Tabs (Diagram 1, call out #4) extend from the walls or the wings and are positioned generally perpendicular to them. They control backing and blocking movement vertically in the "Y" plane, and secure backing to the invention with grips, screws, and other means and methods (Diagram 2, call out #4.1).

The universal framing connector has:

A web 1 and flanges 14 and 15 provide attachment of the universal framing connector to studs, joists, truss cords, and other framing members and flanges 17, 18, 19, 20 provide attachment points for backing, blocking, bridging, and nagging.

Each break or bend 2, 3, 5, 6, 7, 10, 11 and 12 is substantially perpendicular to walls 4 and 9 to provide strength and proper placement of the invention on framing members.

A gap 16 is formed by edges 8 and 13 allows the universal framing connector to wrap, in clamshell fashion, around framing members.

What is claimed is:

1. A universal framing connector comprising:

a web with a first side edge and a second side edge;

a first leg attached to the first side edge of the web, the first leg having a top edge, a bottom edge, and two opposite side edges, respectively;

a second leg attached to the second side edge of the web and being substantially parallel to the first leg, the second leg having a top edge, a bottom edge, and two opposite side edges;

a first flange attached to one of the side edges of the first leg, the first flange being substantially parallel to the web and opposite the web;

a second flange attached to one of the sides of the second leg, the second flange being substantially parallel to the web and opposite the web;

wherein the first flange and second flange are substantially coplanar and extend toward each other;

a gap extending between the first flange and the second flange;

a third flange attached to and extending the length of the top edge of the first leg;

a fourth flange attached to and extending the length of the bottom edge of the first leg;

a fifth flange attached to and extending the length of the top edge of the second leg;

a sixth flange attached to and extending the length of the bottom edge of the second leg;

wherein the third flange and fourth flange are substantially parallel;

wherein the fifth flange and sixth flange are substantially parallel;

wherein the fourth flange and the sixth flange are substantially coplanar and extend in substantially opposite directions; and wherein the third flange and the fifth flange are substantially coplanar and extend in substantially opposite directions.

2. The universal framing connector of claim 1 further comprising:

a first opening in the first leg configured to allow for the passage of a pipe; and a second opening in the second leg configured to allow for the passage of a pipe.

3. The universal framing connector of claim 2 further comprising:

a slot in the web for fastening; and at least one aperture in each of the web, the first flange, the second flange, the first leg, the second leg, the third flange, the fourth flange, the fifth flange, and the sixth flange.

* * * * *